United States Patent [19]

Deguchi et al.

[11] 4,276,978

[45] Jul. 7, 1981

[54] SHEET CONVEYOR FOR USE IN COPYING MACHINES

[75] Inventors: Masanobu Deguchi, Yamatotakada; Takeshi Ikegami, Kurashiki, both of Japan

[73] Assignee: Sharp Kabushiki Kaisha, Osaka, Japan

[21] Appl. No.: 81,434

[22] Filed: Oct. 3, 1979

[30] Foreign Application Priority Data

Oct. 8, 1978 [JP] Japan ..... 53/123929

[51] Int. Cl.[3] ..... B65H 29/04

[52] U.S. Cl. ..... 198/654; 271/204; 271/273

[58] Field of Search ..... 271/82, 204, 206, 273, 271/277; 198/654

[56] References Cited

U.S. PATENT DOCUMENTS

| | | | |
|---|---|---|---|
| 1,238,561 | 8/1917 | Ohl, Jr. | 271/204 X |
| 1,920,715 | 8/1933 | Sager | 271/204 |
| 2,025,371 | 12/1935 | Beidler | 271/204 X |
| 2,508,608 | 5/1950 | Huck | 271/277 X |
| 2,997,157 | 8/1961 | Siebke | 271/204 X |
| 3,116,924 | 1/1964 | Huck | 271/204 X |
| 4,155,545 | 5/1979 | Yanagawa et al. | 271/277 X |

*Primary Examiner*—Robert W. Saifer

*Attorney, Agent, or Firm*—Birch, Stewart, Kolasch & Birch

[57] ABSTRACT

The invention is directed to a sheet gripper structure for use in a copying machine which is affixed to a pair of chains extending between sprockets. The chains include link plates with an improved attachment formed in each of the link plates. A pair of the attachments are secured inside the pair of chains at an interval of the link plates. A sheet pressure rod is mounted on the folded sections of selected ones of the pairs of the attachments in the sheet conveying direction and a sheet retainer is fixed to other selected ones of the pairs of the attachments. The sheet pressure rod carries a pair of symmetrical hold plates inside thereof and a pair of sheet pressure arms outside thereof. The gripper structure comprising the sheet retainer, the hold arm and the sheet pressure arm is installed on the chains, or on a belt conveyor or any other conveyors in such a way to be closed when moving in the straight direction and opened in the process of changing their directions.

8 Claims, 12 Drawing Figures

SHEET CONVEYOR FOR USE IN COPYING MACHINES

BACKGROUND OF THE INVENTION

This invention relates to a sheet conveyor for use in copying machines and the like and adapted for conveying a sheet such as a transcription sheet while the leading edge of the sheet is held by means of a gripper.

Although a conveyor of the above type, for example, a chain delivery type conveyor for use in copying machines will be discussed in the following description with reference to FIG. 1, it should be understood that the present invention is also applicable to any other sheet conveyors.

In FIG. 1, there is illustrated a basic configuration of the chain delivery type sheet conveyor which includes a photosensitive drum 1 rotating in the arrow direction. Around the photosensitive drum 1 there are disposed a corona charger 2 for charging a surface of the photosensitive drum 1 with a voltage, a light exposure optical system 4 including a mirror, a lens, etc, for guiding and focusing onto the surface of the drum 1 an image of an original (not shown) mounted on an original platform 3. In addition, a developer 5 is provided for making visible an electrostatic latent image formed via the optical system, and a sheet conveyor 8, which is directed to the present invention, is disposed in closest proximity to the photosensitive drum 1 within a transcription station 6 for bringing the sheet into contact with the visible image and further conveying the thus transcribed sheet into a fixing station 7 and delivering the same outside. Further a corona charger 9 is disposed within the transcription station 6 for ensuring the efficiency of the transcription operation. Still further a corona charger 10 is provided for removing the residual charge from the photosensitive drum 1 after the transcription operation and a cleaner 11 for removing residual developing agents from the photoconductive surface of the photosensitive drum 1, both of which are also located around the photosensitive drum 1.

The sheet conveyor 8, as indicated in FIG. 2, includes a pair of chains 12 and two pairs of sprockets 13, 14 one pair of which is designed to drive the chains 12. The conveyor 8 further includes a sheet gripper 15 clinging to the chains 12 in a direction normal to the chains. The sheet gripper 15 is adapted to rotate in the direction of the arrow in FIG. 1 and stop rotating just before the transcription station 6.

On the right side of FIG. 1 there is provided a sheet feed assembly including a sheet feed roller 16 rotating in the direction of the arrow and a sheet cassette 17 containing a stack of sheets. Guide rollers 18 and auxiliary rollers 19 are located in a sheet passage between the sheet feed roller 16 and the sheet gripper in a ready position. As soon as the working surface of the photosensitive drum is charged with a given voltage and the leading edge of an image section of the photosensitive drum 1 reaches an optical path of the exposure optical system 4, the original platform 3 starts moving so that the image of the original is projected onto the working surface of the photosensitive drum 1 via the optical system 4. The resulting latent image is developed into a corresponding toner image through the developer 5.

Concurrently with or shortly after the actuation of a pushbutton the sheet feed roller 16 makes a full revolution to pick up only a single sheet 20 from the sheet cassette 17 and move it forward towards the sheet gripper 15 in the ready position. At the same time the sheet conveyor 18 starts rotating in order to bring into synchronism the time when the leading edge of the toner image section reaches the transcription station 6 with the time where the sheet 20 is conveyed into the transcription station 6.

Thereafter, a toner image attached to the working surface of the drum is transferred onto the sheet 20 of which the tip is held by the sheet gripper 15, by the action of the transcription corona charger 9. A residual potential is removed from the photosensitive drum 1 by the corona charger 10 after the completion of the transcription operation. Residual toner is also removed from the working surface of the drum through the cleaner 11. The sheet 20 carrying the toner image transferred thereon is conveyed into the fixing station 7. After the toner image has been heated and fixed, the sheet gripper 15 reaches the sprockets 13 to release the sheet 20 therefrom. Until the leading edge of the sheet 20 travels towards the sheet drain rollers 21, the sheet drain auxiliary rollers 22 are at work to advance the sheet. Then, the sheet 20 is discharged from the copying machine through the sheet drain rollers 21.

FIG. 3 depicts in detail how the sheet gripper 15 holds the sheet 20 within the copying machine of the chain delivery type. In FIG. 3, an attachment 23 is provided to support the gripper 15 which comprises a base plate **15*a* affixed to the attachment 23 and a sheet pressure plate 15*b* pivoted rotatable on the base plate 15*a*. The base plate 15*a* itself is concave and secured via a screw 24 on the attachment 23 which in turn is affixed to the pair of the chains. A sheet pressure bearing 25 is provided on the sheet conveying direction side of the base plate 15*a* and carries a rotatable sheet pressure shaft 26. The sheet pressure plate 15*b* is secured via a screw 27 on the sheet pressure shaft 26. A cam follower 28 is fixed together with the sheet pressure plate 15*b* to the sheet shaft 26 via a screw. A roller 29 is provided below the follower 28. The base plate 15*a* also has an inwardly folded sheet receiving arm 30 and a downwardly folded sheet tip restricting arm 31 on its sheet conveying direction side. A cam 32 is provided in a position to contact the roller 29 extending from the cam follower 28 on the sheet pressure plate 15*b***.

As illustrated in FIG. 3(*a*) the chains are in the stopped position and the sheet gripper 15 is in the ready condition. Under the circumstance the roller 29 extending from the cam follower 28 rides on the cam 32 so that the sheet pressure plate **15*b* is rotated about the sheet pressure shaft and placed in an open position. When this occurs, the sheet 20 strikes on the sheet tip restricting arm 31** and stops at that position.

Upon driving the chains the roller 29 passes over the cam 32 and the sheet pressure plate **15*b* is urged against the base plate 15*a* under the influence of a spring 33 intervened therebetween to sandwich the sheet 20 therebetween. When passing the transcription station the sheet 20 receives the toner image transcribed thereon and the toner image is then fixed at the fixing station. In discharging the sheet the cam 32 is placed in a sheet release position and the sheet pressure plate 15*b* is rotated as shown in FIG. 3**(*a*).

As noted earlier, the sheet gripper structure of the conventional conveyor including the cams, the cam follower, the rotation shaft, the bearing, etc. is rather sophisticated and requires that the sheet be securely sandwiched by means of the spring. The cams are necssary in the sheet hold position and in the sheet release position with position adjustment therefor. The spring mounted on the sheet gripper becomes fatigued gradually due to heat each time it passes over the fixing station. In an extreme case the sheet gripper structure fails to catch the sheet and causes a sheet jam which may produce fire or smoke.

OBJECTS OF THE PRESENT INVENTION

Accordingly, it is an object of the present invention to provide a sheet conveyor assembly which does not need various components or a sophisticated structure in holding and releasing a large number of sheets.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE PREFERRED EMBODIMENTS

Figure 1:
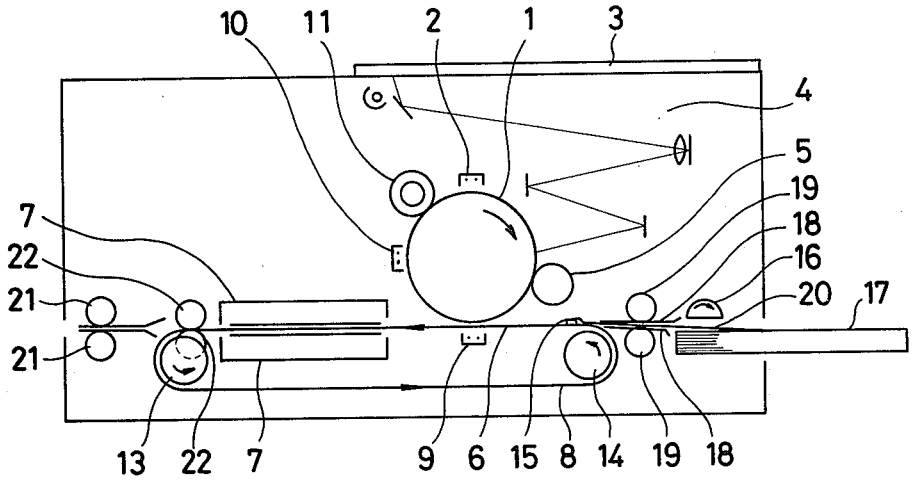
FIG. 1 is a cross sectional view of a chain delivery type sheet conveyor for use in a copying machine.
Figure 2:
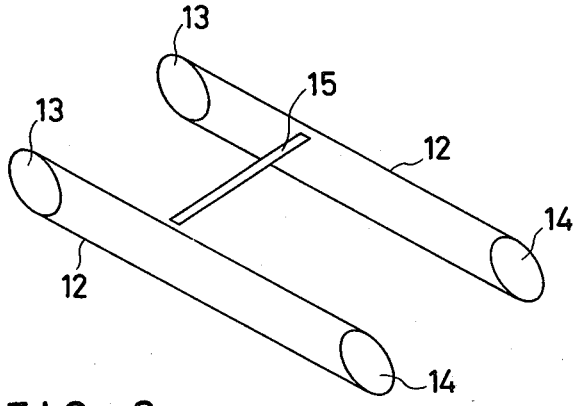
FIG. 2 PRIOR ART
FIG. 2 is a perspective view of the structure of the sheet conveyor of FIG. 1.
Figure 3A:
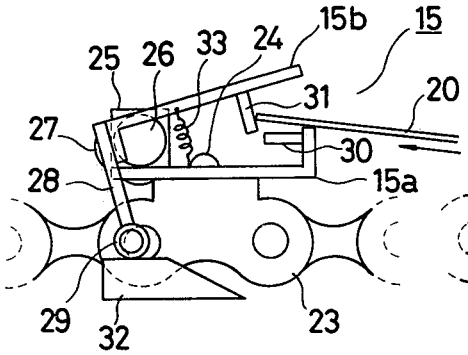
FIG. 3a PRIOR ART
FIGS. 3(*a*) and 3(*b*) are front views of a sheet gripper structure in a conventional sheet conveyor.
Figure 3B:
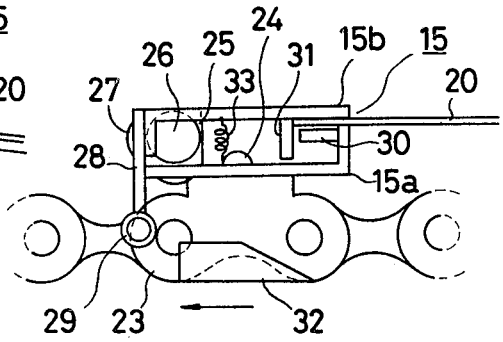
FIG. 3b PRIOR ART
Figure 4:
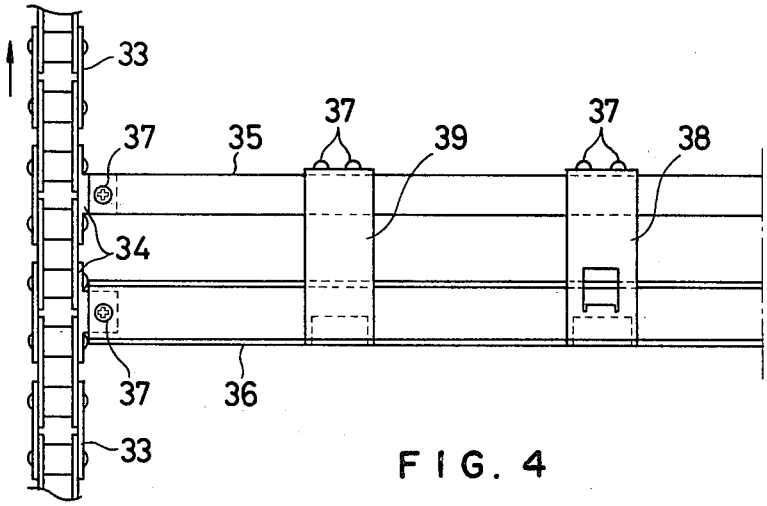
FIG. 4 is a top view of a sheet gripper structure in a sheet conveyor embodying the present invention.
Figure 5:
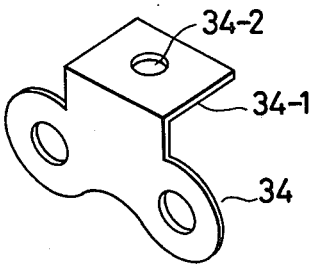
FIGS. 5 through 8 are perspective views showing details of the sheet gripper structure according to the present invention.

Referring now to FIG. 4, there is illustrated a plan view of a sheet gripper structure made according to the present invention. A copying machine with which the sheet gripper structure is used is the same as in FIG. 1 itself. The sheet gripper structure according to the present invention is affixed to the chains 12 extending between the sprockets 13 and 14. According to the teachings of the present invention the chains 12 comprise link plates 33 and an improved attachment 34 formed in each of the link plates 34, the attachment 34 having a folded section 34-1 and a screw hole 34-2 as shown in FIG. 5. A pair of the attachments are secured inside the pair of the chains 12 at the interval of the link plates 33.

Figure 6:
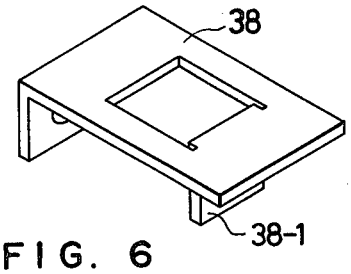
Figure 7:
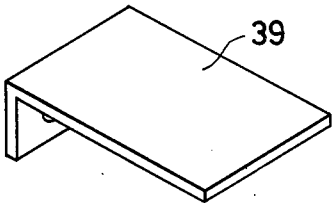
Figure 8:
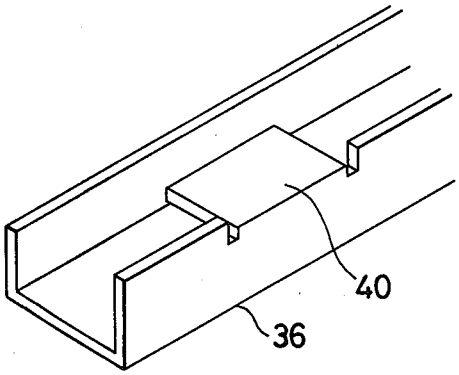

A sheet pressure rod 35 is mounted on the folded sections selected pairs of the attachments 34 in the sheet conveying direction and a sheet retainer 36 is fixed to other selected pairs of the attachments 34 by means of a screw 37. The sheet pressure rod 35 carries a pair of symmetrical hold plates 38 as shown in FIG. 6 inside thereof and a pair of sheet pressure arms 39 as shown in FIG. 7 outside thereof by means of a screw 37 in a direction opposite to the sheet conveying direction. A restricting finger 38-1 is formed on one end of the hold plate 38 by cutting and folding a portion of the one end of the hold plate 38. As indicated in FIG. 8, a portion of the sheet retainer 36 is cut in a position to correspond to the hold plates 38 and the pressure arm 39 and a sheet retaining arm 40 is formed in the cutout of the retainer 36. A plurality of the sheet grippers each comprising a pressure plate having the hold plate 38 and the sheet pressure arm 39 and the sheet retainer 36 may be installed at an interval longer than the maximum size of a copy in the copying machine.

Figure 9:
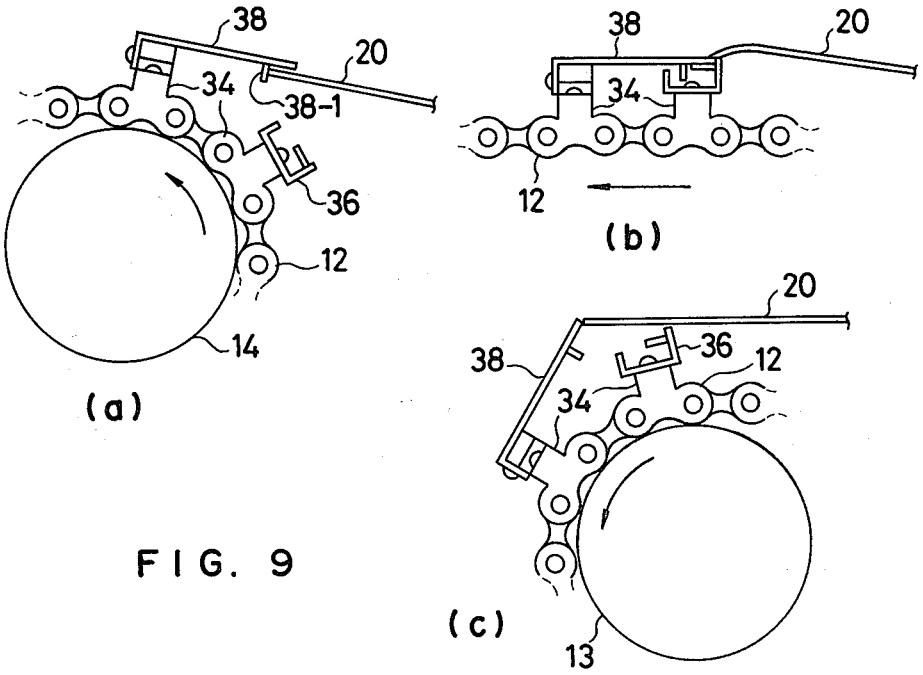
FIG. 9(*a*) through 9(*c*) are front views for illustration of operation of the sheet conveyor according to the present invention.

The sheet gripper according to the present invention will operate in the following manner as viewed from FIGS. 9(*a*) 9(*b*) and 9(*c*). In FIG. 9(*a*), the chains are stationary in the ready position. The chain 12 is going to move the sheet from the delivery position back to the sheet feed position and provide steering for the sheet conveying direction through the sprockets 14. Under the circumstance the hold plate 38, and the sheet pressure arm 39 are urged into the open position so that the sheet 20 is fed from the sheet cassette 17 via the sheet feed roller 16 is arrested by the restricting finger 38-1 on the hold plate 38. The leading edge of the sheet 20 is always kept in contact with the restricting finger 38-1 through the auxiliary roller 19.

Thereafter, the chains begin traveling as indicated by the arrow in FIG. 9(*b*) so that the sheet pressure arm 39, and the hold plate 38 comes into contact with the sheet retainer 36 to sandwich the sheet 20 therebetween.

FIG. 9(*c*) depicts the situation where the sheet gripper structure passes over the fixing station and arrives at the sheet drain position. The hold plate 38 and the sheet pressure arm 39 affixed to the chain 12 pass over the sprockets 13 thus changing its direction in advance of the sheet retainer 36 to thereby gradually open the sheet pressure arm, etc. Shortly thereafter, the sheet retainer 36 approaches the sprockets 13 so that the sheet 20 is completely released from the gripper structure and forwarded toward the sheet drain rollers 22 with the help of the auxiliary rollers 22 and eventually is discharged from of the copying machine.

As stated above, the present invention avoids a sophisticated control mechanism for the sheet gripper structure as experienced in the past and simplifies the sheet gripper structure.

The sheet gripper is in the open position when it reaches the chain driving sprocket and changes direction and is in the closed position when moving in the straight direction. This eliminates the need for the cams, the rollers, the levers, etc. so that the gripper is simple in construction and small by size in itself.

Although in the above embodiment the chains are positioned to extend between the sprockets, it is obvious that a belt may be adopted instead of the chains with the gripper structure being fixed to the belt. In summary, the gripper structure comprising the sheet retainer 36, the hold plate 38 and the sheet pressure arm 39 may be installed on the chains, the belts and any other conveyors in such a way to be closed in the straight direction and opened in the process of changing their directions.

Whereas the present invention has been described with respect to specific embodiments thereof, it will be understood that various changes and modifications may be suggested to one skilled in the art, and it is intended to encompass such changes and modifications as fall within the scope of the appended claims.

What is claimed is:

1. A sheet conveyor for conveying a sheet while the sheet being fed is held by a sheet gripper supported by a conveying means comprising:

a sheet gripper;

a conveying means for transporting said sheet gripper in a substantially straight direction and including means for changing the direction of said conveying means;

said conveying means including attachment means spaced at predetermined positions along a length of said conveying means;

said sheet gripper including a sheet pressure rod and a sheet retainer, said sheet pressure rod being affixed to a first pair of attachment means, said sheet retainer being affixed to a second pair of attachment means, said sheet pressure rod being disposed upstream in the direction of transporting with respect to said sheet retainer;

said sheet retainer being a substantially U-shaped member including, relative to the direction of transporting, a trailing long leg member and a leading shorter leg member, said trailing long leg member including at least one cut-out portion which forms a sheet retaining arm;

said sheet pressure rod including a hold plate with an outwardly projecting restricting finger;

wherein a sheet is supplied to said sheet conveyor during the changing of direction of said conveying means and abuts against said restricting finger of said hold plate, thereafter said conveying means travels in said substantially straight direction and said sheet pressure rod pivots said hold plate and said restricting finger into engagement with said sheet retainer whereby said sheet is sandwiched between said trailing long leg, said sheet retaining arm and said hold plate during transporting through said substantially straight portion and is released during a subsequent changing of direction of said conveying means.

2. A sheel conveyor according to claim 1, wherein each of said conveying means comprises a chain.

3. A sheet conveyor according to claim 1, said sheet retainer including a plurality of cut-out portions which form sheet retaining arms and said sheet pressure rod including a pressure arm adapted to operatively mate with a corresponding sheet retaining arm to sandwich a sheet therebetween.

4. A sheet conveyor according to claim 1, wherein said outwardly projecting restricting finger is received within the spacing between the trailing long leg member and the leading short leg member of said U-shaped sheet retainer.

5. A sheet conveyor according to claim 1, wherein said conveying means comprises two endless chains mounted on two sprocket wheels, said sheet pressure rod and said sheet retainer operatively connected to and extending across the spacing between said two endless chains.

6. A sheet conveyor according to claim 5, said sheet pressure rod further including a pressure arm and said sheet retainer further including a plurality of cut-out portions forming sheet retaining arms, said hold plate and said pressure arm operatively engaging individual sheet retaining arms to sandwich a sheet therebetween.

7. A sheet conveyor according to claim 3 or 6, wherein said pressure arm and said hold plate extending in a downstream direction relative to said sheet pressure rod and the direction of transporting.

8. A sheet conveyor according to claim 4, wherein said restricting finger is formed as a cut-out from said hold plate.

* * * * *

UNITED STATES PATENT AND TRADEMARK OFFICE

CERTIFICATE OF CORRECTION

PATENT NO. : 4,276,978

DATED : July 7, 1981

INVENTOR(S) : Deguchi et al

It is certified that error appears in the above—identified patent and that said Letters Patent is hereby corrected as shown below:

In the category "[30] Foreign Application Priority Data", change "Oct. 8, 1978" to --Oct. 6, 1978--.

Signed and Sealed this

*Twenty-fourth* Day of *November 1981*

[SEAL]

*Attest:*

GERALD J. MOSSINGHOFF

*Attesting Officer*

*Commissioner of Patents and Trademarks*